US012241706B2

(12) United States Patent
Zeman

(10) Patent No.: US 12,241,706 B2
(45) Date of Patent: Mar. 4, 2025

(54) FIREARM RECOIL BUFFER END OF STROKE DAMPER

(71) Applicant: Bryan Zeman, Lake Havasu City, AZ (US)

(72) Inventor: Bryan Zeman, Lake Havasu City, AZ (US)

( * ) Notice: Subject to any disclaimer, the term of this patent is extended or adjusted under 35 U.S.C. 154(b) by 9 days.

(21) Appl. No.: 18/489,045

(22) Filed: Oct. 18, 2023

(65) Prior Publication Data

US 2024/0125569 A1 Apr. 18, 2024

Related U.S. Application Data

(60) Provisional application No. 63/379,980, filed on Oct. 18, 2022.

(51) Int. Cl.
*F41A 3/84* (2006.01)

(52) U.S. Cl.
CPC ..... *F41A 3/84* (2013.01)

(58) Field of Classification Search
CPC .... F41A 3/84; F41A 3/86; F41A 21/26; F41A 21/30; F41A 21/38; F41A 25/12; F41A 25/16; F41C 23/06
USPC ..... 42/1.06, 74, 1.01, 71.01, 72, 73; 89/198, 89/199, 177
See application file for complete search history.

(56) References Cited

U.S. PATENT DOCUMENTS 4,667,566 A * 5/1987 Bosshard ..... F41A 25/10 89/44.01
5,353,681 A * 10/1994 Sugg ..... F41A 25/16 89/43.01
8,468,729 B1 * 6/2013 Sylvester ..... F41A 3/84 42/1.06
9,080,823 B1 * 7/2015 Mantas ..... F41A 3/84
9,927,206 B1 * 3/2018 Smith ..... F41C 23/16
10,941,999 B1 * 3/2021 Termanini ..... F41A 21/38
11,674,763 B2 * 6/2023 Caudle ..... F41A 3/62 89/191.01
2006/0101990 A1 * 5/2006 McGarry ..... F41A 11/00 89/198
2006/0236853 A1 * 10/2006 Boersching ..... F41A 3/70 89/198
2008/0110074 A1 * 5/2008 Bucholtz ..... F41C 23/06 42/1.06
2010/0275482 A1 * 11/2010 Bentley ..... F41C 23/06 42/1.06

(Continued)

FOREIGN PATENT DOCUMENTS

KR 20090112664 A 10/2009

*Primary Examiner* — Michael D David

(74) *Attorney, Agent, or Firm* — Wood Herron & Evans LLP

(57) ABSTRACT

Provided is a drop-in unit end of stoke firearm recoil damper for a firearm having a recoil buffer that linearly reciprocates in a recoil tube. The drop-in damper unit includes a housing cup and a resilient cushion. The cup is configured to fit within a recoil tube and has an internal flange. The resilient cushion is configured to fit within the housing against the flange. The cushion has a tubular shape with a longitudinal central opening and first and second frustoconical end surfaces. Both of the frustoconical end surfaces extend in a forward direction. The cushion is resiliently deformed toward reversing the direction of the frustoconical surfaces in a rearward direction when impacted by the buffer.

8 Claims, 1 Drawing Sheet

(56) References Cited

U.S. PATENT DOCUMENTS

| | | | | |
|---|---|---|---|---|
| 2017/0284765 | A1* | 10/2017 | Spyche, Jr. | F41C 23/06 |
| 2020/0232740 | A1* | 7/2020 | Honigmann | F41A 21/30 |
| 2022/0136787 | A1* | 5/2022 | Caudle | F41A 3/86<br>89/191.01 |
| 2022/0299281 | A1* | 9/2022 | Li | F41A 3/78 |
| 2023/0204311 | A1* | 6/2023 | Spyche, Jr. | F41A 3/94<br>89/198 |
| 2024/0125569 | A1* | 4/2024 | Zeman | F41A 3/84 |

* cited by examiner

FIREARM RECOIL BUFFER END OF STROKE DAMPER

RELATED APPLICATIONS

This application claims priority to U.S. Provisional Patent Application No. 63/379,980, filed Oct. 18, 2022, and incorporates the same herein by reference.

TECHNICAL FIELD

This invention relates to a drop-in end of stroke damper or cushion for a firearm recoil buffer.

BACKGROUND

Some firearm models or patterns, including the common AR-pattern, use a coiled compression spring and a weighted buffer to adsorb recoil force of a reciprocating part of the action (such as the bolt or bolt carrier group) and return the breach into battery. "Tuning" the recoil involves a combination of selecting the compressive force of the spring and the weight of the buffer for the ammunition being used. In some situations, the buffer will reach the full end of its stoke and impact the end of the buffer tube. Sometimes, the buffer is provided with an end cap that has some resiliency, but this can be of limited effective utility. End of stoke dampers or cushions in various forms have been used.

SUMMARY OF THE INVENTION

The invention provides a drop-in unit end of stoke firearm recoil damper for a firearm having a recoil buffer that linearly reciprocates in a recoil tube. The drop-in damper unit includes a housing cup and a resilient cushion. The cup is configured to fit within a recoil tube and has an internal flange. The resilient cushion is configured to fit within the housing against the flange. The cushion has a tubular shape with a longitudinal central opening and first and second frustoconical end surfaces. Both of the frustoconical end surfaces extend in a forward direction. The cushion is resiliently deformed toward reversing the direction of the frustoconical surfaces in a rearward direction when impacted by the buffer.

The present invention provides a resiliently elastomeric ring that is both compressible and deflectable that can be carried in a drop-in cup-like housing to provide an end-of-stroke damper/cushion to be contacted by the buffer.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
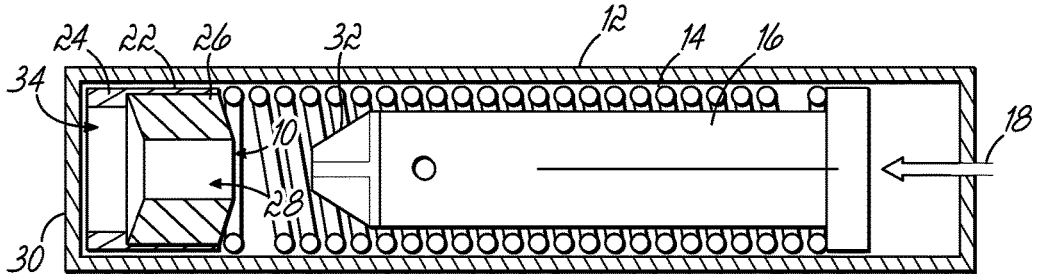
FIG. 1 is schematic side sectional view of an end of stroke cushion according to one embodiment of the present invention showing the buffer in a partially displaced position.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped and/or held in the ordinary manner.

Referring first to FIG. 1, therein is shown a drop-in cushion unit 10 according to an embodiment of the present invention installed in an AR-pattern recoil buffer tube 12. The recoil spring 14 is partially compressed by the buffer 16 that is moving toward the rear, as indicated by the arrow 18. The buffer 16 is pushed by a bolt of bolt carrier group (not shown), as is well-known to those of ordinary skill in the art. The cushion unit 10 includes a support cup 20 or housing in the form of an open-ended cylinder 22 with an inwardly extending annular flange 24 that extends some length forward inside the cylinder 22. A frustoconical annulus/ring 26 made of an elastomeric material and having a central opening 28 is situated inside the cylinder 22 and against the annular flange 24 with the middle portion extending in a generally forward direction. That is, the ring 26 has forward and rearward frustoconical surfaces that both extend in the same direction such that the longitudinal dimension/thickness is about the same at inner and outer edges. The annular flange 24 spaces the ring 26 from the closed end 30 of the buffer tube 12, providing a space into which the ring 26 can be deflected.

The elastomeric ring 26 may be shaped generally like a longitudinally elongated (i.e., "thick") "Belleville washer" made of compressible and deflectable material. A Belleville washer, also known as a coned-disc spring, conical spring washer, disc spring, Belleville spring or cupped spring washer, is a conical shell which can be loaded along its axis either statically or dynamically. A Belleville washer is a type of spring shaped like a washer. It is the frustoconical shape that gives the washer its characteristic spring. A standard Belleville washer would be made of metal and have limited flex, whereas the ring 26 of the present invention is elastomericly compressible and deformable to, and if desired, beyond a flat condition.

The unit 10 can easily be retrofitted into an existing buffer tube 12 of an AR-pattern firearm, for example, as a "drop-in" upgrade. The cup may be cylindrical with a diameter sized to fit a standard buffer tube 12 (as shown) or could be sized to fit inside a coiled recoil spring.

Figure 2:
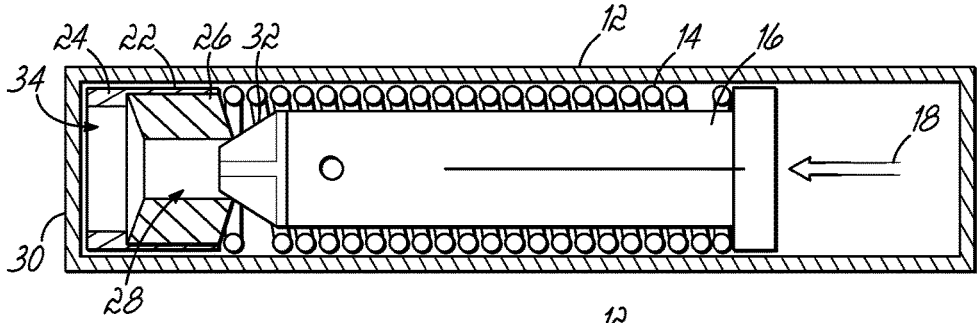
FIG. 2 is a similar view showing the buffer making initial contact with the cushion.
Figure 3:
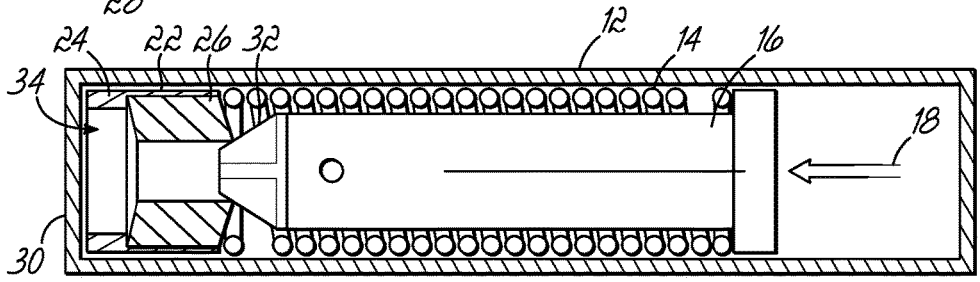
FIG. 3 is a similar view showing the cushion beginning to compress and deflect.
Figure 4:
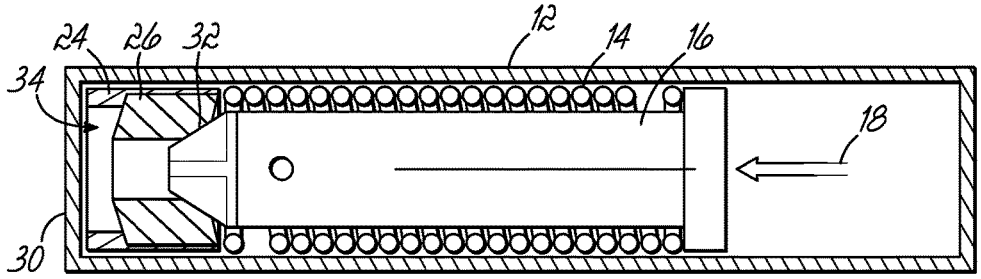
FIG. 4 is a similar view showing the further deflection of the cushion.

Referring now to FIG. 2, as the position of the buffer 16 moves further toward the rear, the recoil spring 14 further compresses and the rear tip 32 of the buffer 16 contacts the center edge of the elastomeric ring 26. As shown in FIG. 3, as the position of the buffer 16 continues rearward, the ring 26 will begin to resiliently compress and begin to damp the rearward movement of the buffer 16. Continued compression (FIG. 4) results in further compression and deflection of the ring 26 material. The conical shape is flattened, which further adsorbs dynamic energy of the moving buffer 16. This effects both compression and bending of the resilient ring 26.

Figure 5:
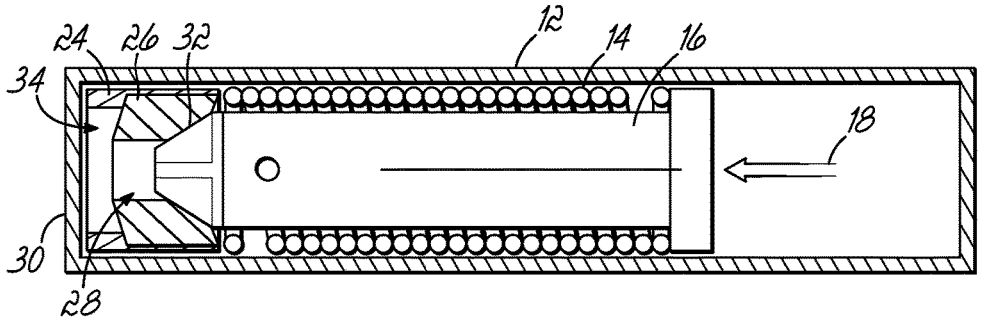
FIG. 5 is a similar view showing the cushion fully deflected and compressed.

As shown in FIG. 5, at the end of the stroke, the conical shape of the ring 26 may be reversed and project into the space 34 provided by the annular flange 24. As the movement of the buffer 16 is reversed and returned forward by the recoil spring 14, the ring 26 resiliently returns to its original shape.

The rear tip 32 of the buffer may be formed with frustoconical radial blades, as shown, that concentrate compressive forces on the elastomeric material of the ring 26.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A drop-in unit end of stroke firearm recoil damper for a firearm having a recoil buffer that linearly reciprocates in a recoil tube, comprising;

a drop-in damper unit including:

a housing cup configured to fit within a recoil tube, a housing having an internal flange and a resilient cushion configured to fit within the housing against the flange, the cushion having a tubular shape with a longitudinal central opening and first and second frustoconical end surfaces, both frustoconical end surfaces extending in a forward direction, wherein the cushion is resiliently deformed toward reversing the direction of the frustoconical surfaces in a rearward direction when impacted by the buffer.

2. The unit of claim 1, wherein the cup is substantially cylindrical.

3. The unit of claim 1, wherein the internal flange is at a rearward end of the cup.

4. The unit of claim 1, wherein the cup has an open rear end.

5. The unit of claim 1, wherein the cup fits removably in a recoil tube.

6. The unit of claim 1, wherein the cup has a forward edge configured to engage a recoil spring.

7. A drop-in unit end of stroke firearm recoil damper for a firearm, comprising;

a recoil buffer that linearly reciprocates in a recoil tube;

a drop-in damper unit including:

a housing cup configured to fit within a recoil tube, a housing having an internal flange and a resilient cushion configured to fit within the housing against the flange, the cushion having a tubular shape with a longitudinal central opening and first and second frustoconical end surfaces, both frustoconical end surfaces extending in a forward direction, wherein the cushion is resiliently deformed toward reversing the direction of the frustoconical surfaces in a rearward direction when impacted by the buffer.

8. The unit of claim 7, wherein the buffer includes a rearward end formed with frustoconical radial blades that concentrate compressive forces on the elastomeric material of the cushion.

* * * * *